US006016583A

United States Patent [19]

Stanton

[11] Patent Number: 6,016,583

[45] **Date of Patent: *Jan. 25, 2000**

[54] METHOD FOR CREATING PATTERNS IN DYED GARMENTS AND FOR CREATING A JACQUARD LOOK IN GARMENTS

[75] Inventor: Steve Stanton, Glendale, Calif.

[73] Assignee: Los Angeles Dye and Wash Co., Inc., City of Commerce, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,821

[22] Filed: Dec. 31, 1997

[51] Int. Cl.[7] ..... D06B 1/02

[52] U.S. Cl. ..... 8/150; 8/114.6; 8/158; 28/167; 68/205 R

[58] Field of Search ..... 8/150, 158, 114.6, 8/115; 68/205 R; 28/167, 169

[56] References Cited

U.S. PATENT DOCUMENTS

| | | | |
|---|---|---|---|
| 1,588,951 | 6/1926 | Dreyfus | 8/115 X |
| 4,845,790 | 7/1989 | Brasington | 68/205 R X |
| 4,995,151 | 2/1991 | Siegel et al. | 28/169 X |
| 5,301,401 | 4/1994 | Suzuki et al. | 28/167 |
| 5,337,460 | 8/1994 | Cockfield et al. | 28/167 |
| 5,632,072 | 5/1997 | Simon et al. | 28/167 X |
| 5,737,813 | 4/1998 | Sternlieb et al. | 28/167 |

*Primary Examiner*—Philip R. Coe

*Attorney, Agent, or Firm*—Blakely, Sokoloff, Taylor & Zafman LLP

[57] ABSTRACT

A method for forming patterns or to create a Jacquard effect in dyed fabric. A nozzle type is selected. The water pressure is selected. Temperature of the water is selected. The distance between the nozzle and the garment is adjusted. The water is directed to the garment to selectively remove dye from the dyed garment to form a particular pattern.

3 Claims, 1 Drawing Sheet

METHOD FOR CREATING PATTERNS IN DYED GARMENTS AND FOR CREATING A JACQUARD LOOK IN GARMENTS

BACKGROUND OF THE INVENTION

1. Field of the Invention

The present invention relates generally to the processing of fabrics and in particular to a method for creating pattern in dyed garments and for creating a Jacquard look in garments.

2. Description of the Related Art

Conventional techniques for imprinting patterns onto garments include silk-screen type processes. First, a silk-screen having a desired pattern is created. Next, ink, or a dye remover (e.g., a bleach or other harsh chemical) is applied to an area on the garment defined by the silk-screen. In the case of ink, the garment is imprinted with the ink pattern. In the case of a dye remover, the chemical selectively removes dye from an area of the garment defined by the silk-screen. An alternative process can be applied to non-dyed fabrics. In this process, a dye resist chemical is applied to the non-dyed fabric by employing a silk-screen pattern. Thereafter, the fabric is dyed and a pattern, corresponding to the silk-screen, emerges because the dye colors the entire garment except for the areas treated by the dye resist chemical.

These conventional methods suffer from the following disadvantages. First, the dimensions of the silk-screen and the size of a silk-screen imprinting machine limits the size of the pattern. For example, it is impractical to design a silk-screen featuring a design that stretches along the entire length of a pair of pants. As a further example, a typical silk-screen imprinting machine is not adapted to imprint a pattern that stretches the entire length of a T-shirt (e.g., neck line to waist line). Moreover, the cost to manufacture such a silk-screen having large dimensions is impractical.

Furthermore, the processes that employ a silk-screen yield an uneven result on fabrics or garments that do not have flat surfaces. For example, if one were to imprint a logo on an area of a garment that included raised areas (such as belt loops, or borders around pockets), the ink around the crease marks and/or raised areas is uneven and unsightly.

An alternative method to form patterns on garments is to employ costly laser equipment to burn off indigo dye on indigo denim. This laser machine costs approximately $200,000.00 and to Applicant's knowledge, operates only to burn off indigo dye on indigo denim. This approach is very expensive and does not allow for artistic input.

Furthermore, none of these conventional methods can create a Jacquard effect or look on garments. The Jacquard weave is an expensive process and involves configuring a garment weaving machine in a particular fashion to generate a Jacquard pattern. The remainder of the garment is made with a standard weave. The two pieces (one piece having the Jacquard weave and a second piece having the normal weave) are then sewn together to create a garment having a portion thereof exhibiting a Jacquard weave.

Accordingly, there remains a need in the industry for an improved method for creating patterns in dyed garments and for creating a Jacquard look in garments.

BRIEF SUMMARY OF THE INVENTION

An improved method to create patterns in dyed garments is disclosed. A pressure washer having a tank for storing water and a control panel for adjusting characteristics of the water is employed to provide water at certain characteristics through a hose and nozzle. The pressurized water selectively removes dye from the dyed garment to create and form patterns in the dyed garment. Parameters, such as the water temperature, the water pressure, the nozzle type, the distance between the nozzle and the fabric, and length of time during which the water is applied to the garment, can be varied by an operator to suit a particular application. The dye strength and fabric type of the garment are factors that affect the selection of the parameters noted above.

Another aspect of the present invention is to employ a pressure washer to create a Jacquard look in garments. Pressurized water is selectively directed to a non-dyed garment to braid the garment. Thereafter, the braided garment is dyed. The braided or raised areas in the dyed garment are lighter than the remainder of the garment. The braided pattern resemble that of a Jacquard weave. Alternatively, the garment can first be turned inside out. Thereafter, pressurized water can be applied to the inside of the garment to selectively braid a desired pattern. Thereafter, the braided garment is dyed. In this case, since the garment was turned inside out, the braided pattern is lighter than the non-braided portion of the garment.

BRIEF DESCRIPTION OF THE DRAWINGS

The objects, features and advantages of the method and apparatus for the present invention will be apparent from the following description in which.

DETAILED DESCRIPTION OF THE INVENTION

Figure 1:
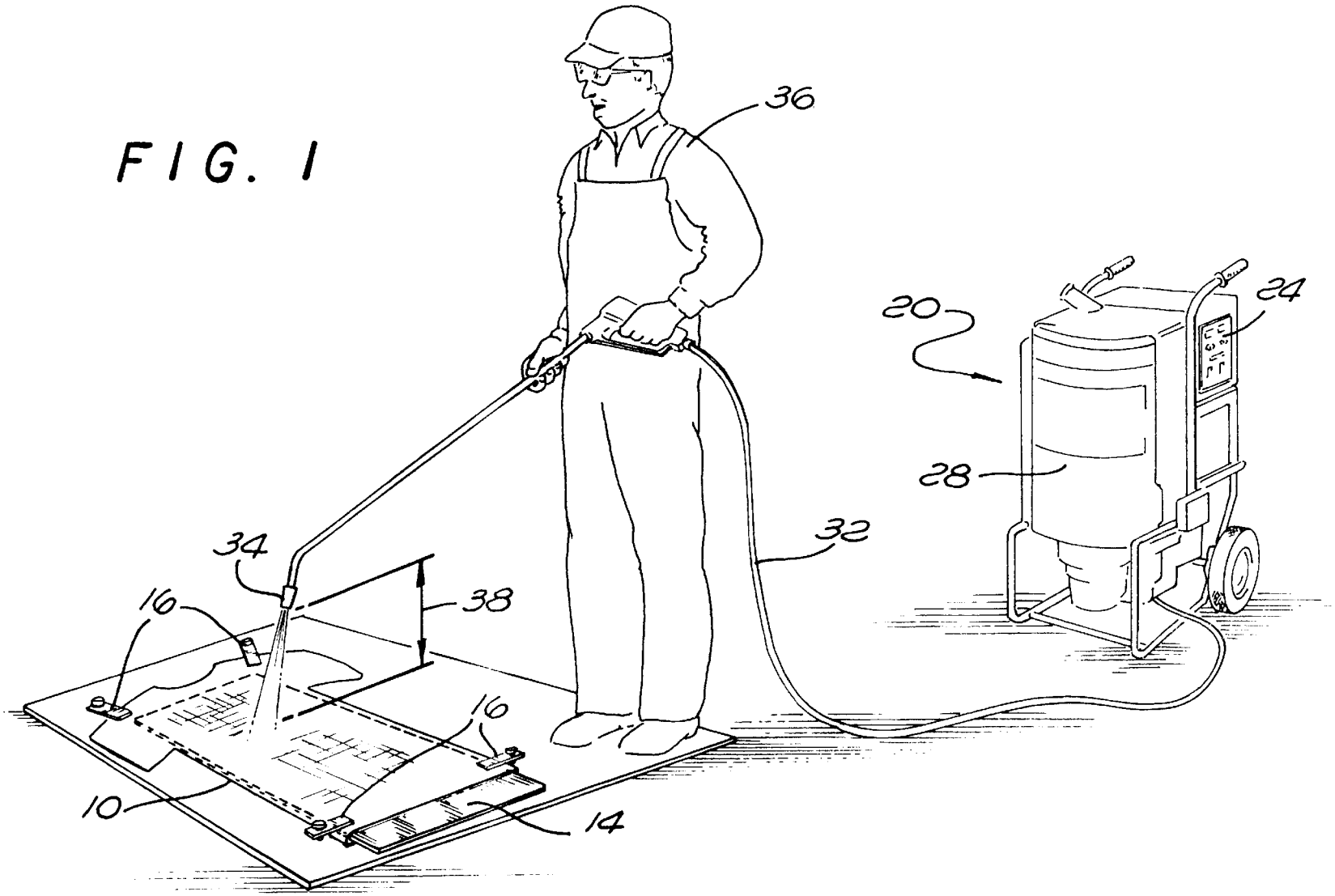
FIG. 1 illustrates components that are employed to practice the present invention.

Referring to the FIGURE, exemplary embodiments of the invention will now be described. The exemplary embodiments are provided to illustrate aspects of the invention and should not be construed as limiting the scope of the invention.

The inventor of the present invention has discovered that patterns may be formed in dyed garments by removing dye from the dyed garments through the application of water. The application of water includes several parameters which will be discussed hereinafter in greater detail.

FIG. 1 illustrates components that are employed to practice the present invention. A dyed garment 10 (e.g., a shirt or a pair of pants) is first secured by means for securing the garment 10. Means for securing can be a substantially rigid insert 14 that has a substantially rectangular shape. For example, this insert 14 can be made of a plastic material. An operator 36 secures the garment 10 to the insert 14 by placing the operator's 36 foot on top of the garment 10 and the insert 14. In the alternative, the garment 10 can be secured to a base object (e.g., a work table, work bench, or the floor) by employing one or more clamps 16. One can also secure the garment without an insert 14. For example, one can secure one end of the garment to the floor by placing one's foot atop the garment.

It will be evident to those skilled in the art that the process taught by the present invention can be applied to dyed or non-dyed fabric, as well as garments. For example, the process can be applied to fabrics, and thereafter, garments can be made from those fabrics.

In order to form stripes and lines in a garment 10, it is important to employ means for securing the garment to a base object. Otherwise, the lines and stripes would not be uniform nor straight as the garment 10 will crumple under the pressure of the water being directed thereto. The use of means for securing the garment is not as important or not desired when a more random or non-uniform pattern is desired.

A pressure washer 20 provides pressurized water that is directed to the garment. The pressure washer 20 includes a hose 32 for transporting water stored in a tank 28 to a nozzle 34. The pressure washer 20 includes a control panel 24 that can be adjusted by the operator 36 to vary the pressure and temperature.

The pressure washer 20 can be a portable pressure washer manufactured by AaLadin® Cleaning Systems of Commerce, California For example, the inventor has found that the AaLadin Industrial High Pressure Washer Model 1440 can be employed to practice the present invention.

I. Overview of the Present Invention

An operator first prepares the pressure washer 20 by filling the tank 28 with water and by setting and adjusting the controls 24 to suit a particular application. The operator 36 also selects a particular nozzle having a specified number of orifices with each orifice having a specified shape (e.g., generally circular shape or a generally oval shape) that suits the particular application. The operator 36 then secures the dyed garment 10 in the manner described previously.

The operator 36 can vary parameters, which can include, but are not limited to, the following: pressure, temperature, type of nozzle, distance between the nozzle and the garment, and strength of dye. Each of these parameters are discussed in order hereinafter. Some of these parameters, such as pressure and temperature, are adjusted by the operator 36 by employing the controls 24, associated with the pressure washer 20. Other parameters, such as type of nozzle and strength of dye, are determined by the operator 36 prior to the step of creating the patterns on the garments. For example, the dyeing process, such as the dyeing processes provided by L.A. Dye & Wash of Commerce, California, are applied to the garment before applying the pressurized water, except for the creation of the Jacquard look, discussed hereinafter, in which the pressurized water is applied for the garment before dyeing. Other parameters, such as the distance between the nozzle and the garment, can be selectively adjusted by the operator 36 at the time the pressurized water is applied to the garment. It is noted that some of these parameters are dependent on each other. For example, by decreasing the distance between the nozzle and the garment, the pressure at the garment is effectively increased. Similarly, by decreasing the orifice size, the pressure at the nozzle is effectively increased.

A. Pressure

The inventor has found that a minimum pressure of approximately 500 pounds per square inch (PSI) is needed to remove "weak" dyes, such as pigment sulfur dyes. The inventor has also discovered that for "strong" dyes, such as reactive dyes, a pressure of approximately 2,100–2,300 PSI is effective for removing the dye. The method of the present invention is especially effective for removing pigment-type dye and sulfur-based dye.

B. Temperature

Depending on the application, the temperature of the water employed to remove the dye from the garments can be varied. Water at room temperature can be used. For dyes that are "stronger", temperatures of approximately 150° F.–200° F. can be used to effectively remove the dye. In most applications, the use of unheated water can effectively create patterns in the dyed garment.

C. Type of Nozzle

The operator 36 can also employ different nozzles having one or more orifices. Each orifice can feature a different spray pattern and size to create a desired pattern on the garment 10. The number of orifices can also be adjusted for a particular effect. For example, multiple orifices (e.g., two) can be employed to form swirl patterns in the garment. It will be noted by those skilled in the art that the diameter of an orifice affects the pressure of the water being provided therefrom. In one embodiment, orifices of 1/32and 1/64of an inch can be employed to create lines and stripes of different widths.

D. Distance Between the Nozzle and the Garment

The operator 36 also controls the distance 38 between the nozzle tip and the garment 10. The smaller the distance 38 between the garment 10 and the nozzle 34, the finer or narrower the resulting pattern generated on the garment 10. Likewise, the greater the distance 38 between the garment 10 and the tip of the nozzle 34, the wider or coarser the pattern generated on the garment 10. Distances of approximately one to six inches have been found effective for removing the dye. It will be understood by those skilled in the art that decreasing the distance between the nozzle and the garment "effectively" affects the pressure of the water provided to the garment.

E. Strength of Dye

In order to further describe how the method of the present invention can be practiced for different applications, provided herein are several examples of how the inventor has created different patterns on different types of garments by varying the above-specified parameters.

II. Examples for Creating Stripes on Dyed Garments

A. Denim Pants

Pressurized water at approximately 2,100–2,300 PSI is applied to the denim. The water temperature is preferably 80° F.–100° F. A nozzle having a single orifice with a diameter of approximately 1/16, 1/32or 1/64of an inch can be employed. The operator positions the nozzle at approximately one to six inches from the surface of the garment. The duration of application of the water is approximately one-half (0.5) seconds. For example, an operator can direct the stream of pressurized water in a quick up and down motion to form stripes along the length of the denim pants.

B. Twill Pants

Pressurized water at approximately 1,900–2,100 PSI is applied to the twill. The water temperature is preferably 150° F. A nozzle having a single orifice with a diameter of approximately 1/16, 1/32or 1/64of an inch can be employed. The operator positions the nozzle at approximately one to six inches from the surface of the garment. The duration of application of the water is approximately one-half (0.5) seconds. For example, an operator can direct the stream of pressurized water in a quick up and down motion to form stripes along the length of the twill pants.

C. Heavy Cotton Sweatshirt

Pressurized water at approximately 1,900–2,100 PSI is applied to the heavy cotton sweatshirt. The water temperature is preferably 120° F. A nozzle having a single orifice with a diameter of ½inch can be employed. The operator positions the nozzle at approximately one to six inches from the surface of the garment. The duration of application of the water is approximately one-half to one (0.5 to 1) seconds. For example, an operator can direct the stream of pressurized water in a quick up and down motion to form stripes along the length of the heavy cotton sweatshirt.

D. Light Cotton Shirt

Pressurized water at approximately 1,500–1,800 PSI is applied to the light cotton shirt. The water temperature is preferably 120° F. A nozzle having a single orifice with a diameter of approximately ½inch can be employed. The operator positions the nozzle at approximately one to six inches from the surface of the garment. The duration of application of the water is approximately one-half to one (0.5 to 1) seconds. For example, an operator can direct the stream of pressurized water in a quick up and down motion to form stripes along the length of the light cotton shirt.

III. Examples of Creating a Jacquard Look for Garments

A. Denim Pants

1. Braided Sections Lighter than Remainder of Pants

The non-dyed garment (white garment) is first turned inside out. Pressurized water is applied to the inside of the pants to braid the pants. Thereafter, the braided garment is dyed. The Jacquard-look braided pattern is lighter than the remainder of the pants. In other words, the raised area of the pants is lighter than the non-braided areas of the pants. Generally, a higher pressure setting and temperature setting is employed to braid the garment. To create the Jacquard-look or effect, threads in the garment are broken. Consequently, a higher pressure setting such as approximately 2,300 PSI or greater is employed. Higher temperatures are also more suitable for creating the Jacquard effect. Depending on the type of fabric employed in the garment, one can selectively adjust the pressure and temperature so that the pressurized water does not tear or shred a hole in the garment.

B. Twill Pants

The non-dyed garment (white garment) is first turned inside out. Pressurized water is applied to the inside of the pants to braid the pants. Thereafter, the braided garment is dyed. The Jacquard-look braided pattern is lighter than the remainder of the pants. In other words, the raised area of the pants is lighter than the recessed or flat areas of the pants. Generally, a higher pressure setting and temperature setting is employed to braid the garment. To create the Jacquard-look or effect, knitting in the garment and/or threads are broken. Consequently, a higher pressure setting such as approximately 2,300 PSI or greater is employed. Higher temperatures are also more suitable for creating the Jacquard effect. Depending on the type of fabric employed in the garment, one can selectively adjust the pressure and temperature so that the pressurized water does not tear or shred the garment.

The exemplary embodiments described herein are provided merely to illustrate the principles of the invention and should not be construed as limiting the scope of the invention. Rather, the principles of the invention may be applied to a wide range of systems to achieve the advantages described herein and to achieve other advantages or to satisfy other objectives as well.

What is claimed:

1. A method for creating a Jacquard effect on a garment comprising the step of applying pressurized water to an undyed garment to selectively braid a pattern onto the garment.

2. The method of claim 1 further comprising the step of dyeing the braided garment so that the braided pattern is darker than the remainder of the garment.

3. A method of creating a Jacquard effect on a garment comprising the steps of:

a) turning the garment inside out;

b) applying pressurized water to the inside of the garment to selectively braid a pattern into the garment; and c) dyeing the braided garment so that the braided pattern is lighter than the remainder of the garment.

* * * * *